United States Patent [19]

Lancour et al.

[11] Patent Number: 4,930,718

[45] Date of Patent: Jun. 5, 1990

[54] FENCING DISPENSER

[75] Inventors: Jeff J. Lancour; Ronald D. Chouinard, both of Escanaba; Carl J. Wick, Gladstone, all of Mich.

[73] Assignee: L & C Enterprises - USA, Inc., Escanaba, Mich.

[21] Appl. No.: 287,496

[22] Filed: Dec. 21, 1988

[51] Int. Cl.[5] ..... B65H 49/38

[52] U.S. Cl. ..... 242/86.5 R

[58] Field of Search ..... 242/86.5 R, 86.52, 86.7, 242/86.8, 86.2, 129; 414/24.5, 24.6, 911

[56] References Cited

U.S. PATENT DOCUMENTS

| | | | |
|---|---|---|---|
| 2,616,636 | 11/1952 | Aden | 242/86.5 R |
| 2,914,270 | 11/1959 | Parker et al. | 242/86.5 R |
| 3,048,348 | 8/1962 | Griffin | 242/86.5 R |
| 3,079,129 | 2/1963 | Hulburt | 242/86.5 R |
| 3,661,340 | 5/1972 | Trussell | 242/86.8 |
| 3,722,861 | 3/1973 | Anderson | 242/86.7 X |
| 4,643,625 | 2/1987 | Horner | 414/24.5 |
| 4,775,114 | 10/1988 | Farnsworth | 242/86.5 R |

*Primary Examiner*—Donald Watkins

*Attorney, Agent, or Firm*—John R. Benefiel

[57] ABSTRACT

A vehicle mounted dispenser for fencing fabric including a normally upright cage receiving a roll of fencing fabric to be dispensed through either of a pair of slots on either side of the cage. The cage is pivotally mounted on a holder structure attached to the vehicle to be able to be powered to a horizontal position and lowered onto the ground, so that a roll of fabric can be easily introducted through a gate opening at the front of the cage. In a rear mounted design adapted to tractors, the holder structure is powered to either side of the tractor, while in a front mounted version, an outrigger guide post system guides the fabric around the side of the vehicle.

12 Claims, 8 Drawing Sheets

FENCING DISPENSER

FIELD OF THE INVENTION

This invention concerns a dispensing apparatus and more particularly apparatus adapted to dispense fencing fabric from a roll during installation of the fencing.

BACKGROUND OF THE INVENTION

In the installation of fencing fabric material such as chain link, the fencing is unwound from a large, heavy roll of fabric to be disposed along a series of line posts. After appropriate stretching, the fencing is secured to the posts. The positioning of the fencing fabric along the line posts and proper tensioning thereof is a major part of the job of installing a fence, and often is done manually. The fabric fencing has heretofore been placed in a cage frame mounted vertically to a tractor or other utility vehicle with the fabric fencing paid out from the cage, as it is unwound from the fencing roll, to provide a power assist in this aspect of the installation.

A significant problem with this approach has been the labor and difficulty involved in placing the roll of fencing into the upright cage. Another difficulty concerns a proper payout of fencing, such as to insure a flat positioning of the fencing fabric against the line post and avoiding getting it entangled with the vehicle structure or beneath the wheels of the utility vehicle.

Often times the fencing must be paid out on one side or the other of the tractor, or other utility vehicle, and heretofore a conveniently changable orientation of the fencing cage has not been afforded by the designs employed. That is, for payout either to the left or the right of the vehicle as it proceeds down a fence line. This approach does not conveniently allow stretching by means of a pulling force exerted by the tractor.

Accordingly, it is an object of the present invention to provide a fencing fabric dispenser in which loading of the fencing roll is relatively convenient, and readily accomplished.

It is another object of the present invention to provide such fencing fabric dispenser, which is quickly adaptable to left or right hand feeding and either from a rear mount on tractors, or from a front mounting to other utility vehicles.

It is still another object of the present invention to provide such fence fabric dispenser in which proper feeding of the fencing is insured and proper tensioning is able to be exerted by the pull of the vehicle.

SUMMARY OF THE INVENTION

These and other objects of the present invention which will become apparent upon a reading of the following specification and claims, are achieved by a fencing fabric dispenser including a cage provided by an elongated, open frame work, which is pivotally mounted to a holder structure, in turn secured to the vehicle being employed. The cage is mounted for powered pivoting motion such as to be rotated into a horizontal position and lowered on its side to grade level. A hinged door is opened on the outward side, and affords an entrance ramp to allow convenient rolling of a fence roll into the cage, with the cage door thereafter closed. The cage is then elevated and pivoted back to the upright position, ready for dispensing of fencing fabric. The fencing fabric is passed out between either of pairs of spaced posts on either side of the cage, each pair defining a feed slot.

In a first version, adapted for rear mount to a three point hitch of tractor vehicles, the leading of each pair of posts are provided with a series of pins to enable anchoring of the end of a fencing fabric segment to allow tensioning of the fence by the vehicle movement.

In the rear mounted version, the cage is mounted for powered side-to-side positioning on a pair of rails and a power cylinder is selectively operated to slide the cage to one side or other, conveniently allowing adaption for either right handed or left handed payout of the fencing fabric.

A stablizing hook restraint is incorporated in the holder frame to provide a resistance of the cage to pulling loads when in the upright position and while accommodating the pivoting rotation of the cage incidental to loading of a roll of fencing fabric.

In a second, front mounted version of the fencing dispenser according to the present invention, the cage remains centrally located and the fencing fabric is guided around an outrigger guide post alternatively secured on either side of the fencing cage mounted on the cage holder frame. The guide posts are adjustably positioned and able to be quickly installed on either side of the vehicle for right or left hand payout of the fabric from the dispenser.

The dispenser cage similarly provides slots each defined by a pair of closely spaced longitudinal posts. A lower tube segment is mounted to the cage, and located slightly forward of the stationary guide posts and engaging the lower portion of the fabric as it passes over the fixed feed posts, which maintains the fabric in an outboard position, and also generates a slight upward force exerted on the fabric. This results in controlled dispensing of the fabric over the guide post.

The guide post is also provided with a series of hooking pins spaced along the height thereof, which come into engagement with the fencing fabric upon rotating the guide post to a tensioning position after the fencing material has been completly dispensed such as to allow the vehicle to pull the fencing while in engagement with the guide post to complete the fence stretching procedure.

In an alternate arrangement, the guide post is swingably powered to a tilted position to maintain its vertical position when the apparatus is operating on an inclined contour.

DETAILED DESCRIPTION

In the following detailed description, certain specific terminology will be employed for the sake of clarity and a particular embodiment described in accordance with the requirements of 35 USC 112, but it is to be understood that the same is not intended to be limiting and should not be so construed inasmuch as the invention is capable of taking many forms and variations within the scope of the appended claims.

FIGS. 1–9, depict the rear mounted version of the fabric fencing dispensing apparatus according to the present invention.

Figure 1:
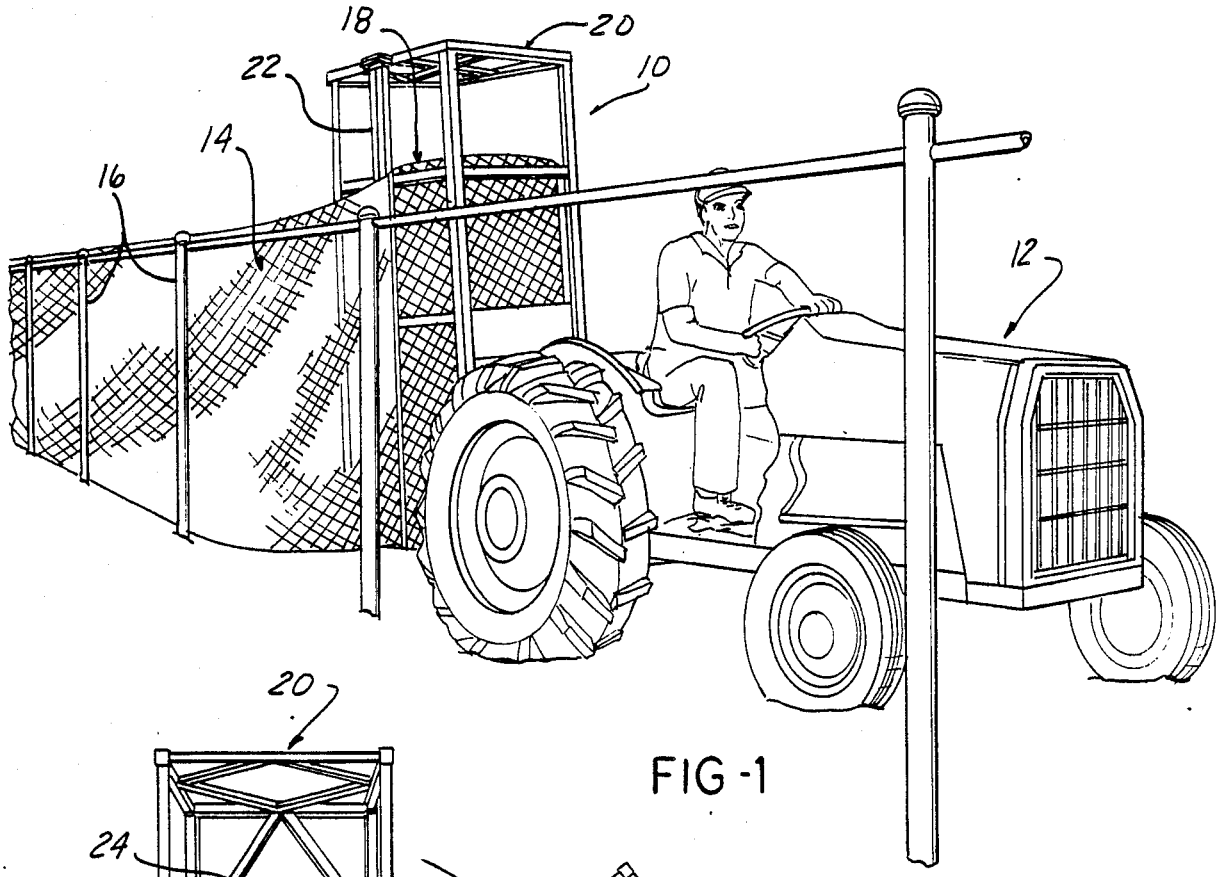
FIG. 1 is a perspective view of the rear mounted embodiment of a fencing fabric dispenser according to the present invention, shown installed on the rear of a tractor, and in use in feeding fencing fabric along a series of line posts.
Figure 2:
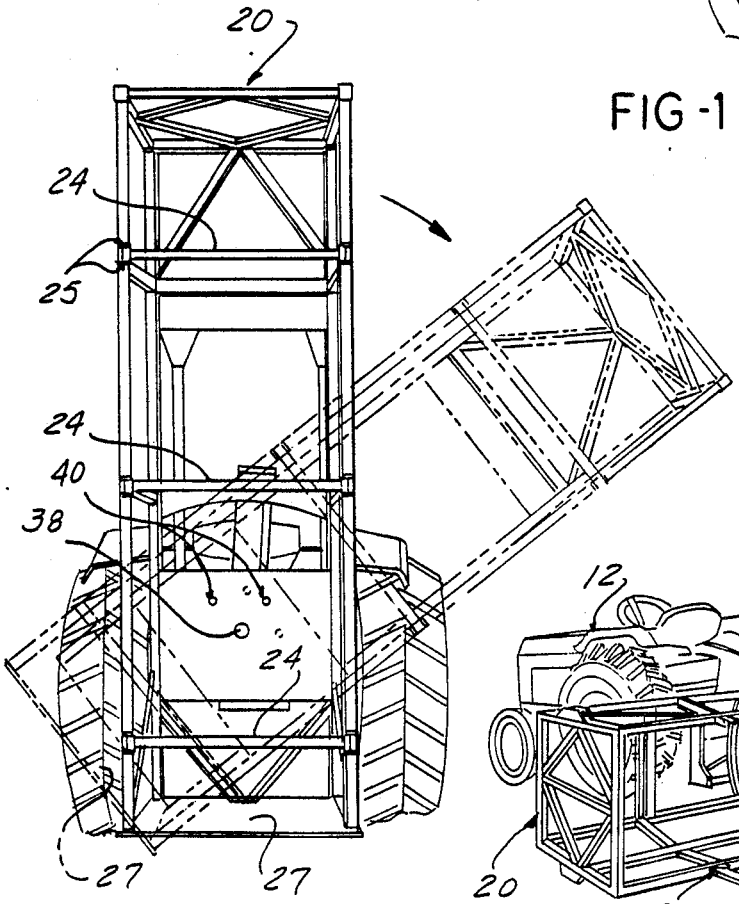
FIG. 2 is a rear elevational view of the vehicle and the fencing dispenser shown in FIG. 1, illustrating the tilting motion of the fencing dispenser cage incidental to preparing for loading of a roll of fencing fabric.
Figure 3:
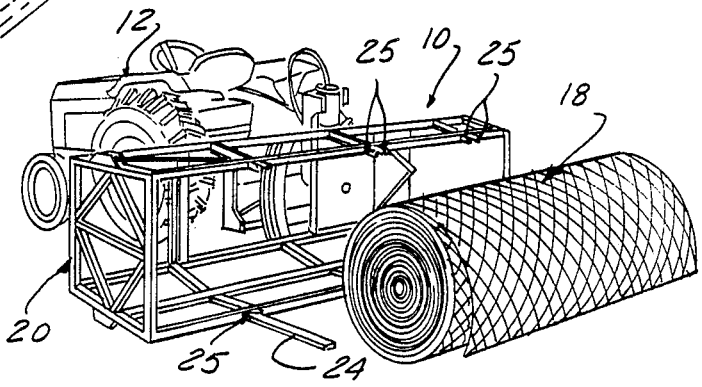
FIG. 3 is a perspective view of a vehicle and fencing fabric dispenser in the horizontal open position, depicting the loading of a roll of fencing fabric thereinto.

As shown in FIG. 1, in use, a fencing fabric dispenser 10 according to the present invention is particularly designed for rear mounting as to a three point hitch of a tractor 12 such as to allow a fabric fencing material 14 to be dispensed along a line of fence posts 16 from a roll 18 of fencing material 14 mounted within a cage 20. The fencing material 14 passes out in between a slot 22, formed in the cage structure 20. The cage structure 20 is comprised of an open frame work, forming a rectangular elongated structure normally positioned in the upright vertical position, shown in FIGS. 1 and 2 but is adapted to be pivoted under power about a pivot axis defined by a trunnion pin 38 to move sideways to the horizontal position as shown partially in phantom in FIG. 2 and completed in FIG. 3. The rear wall of the cage structure 20 is formed by a series of individual releasable arms 24, held between tabs 25 which form a gate opening when released, and in addition provide a ramp surface to enable ready loading of the fencing roll 18 into the interior of the cage 20.

Thereafter, the cage 20 is elevated and powered again to the upright operative position.

Figure 4:
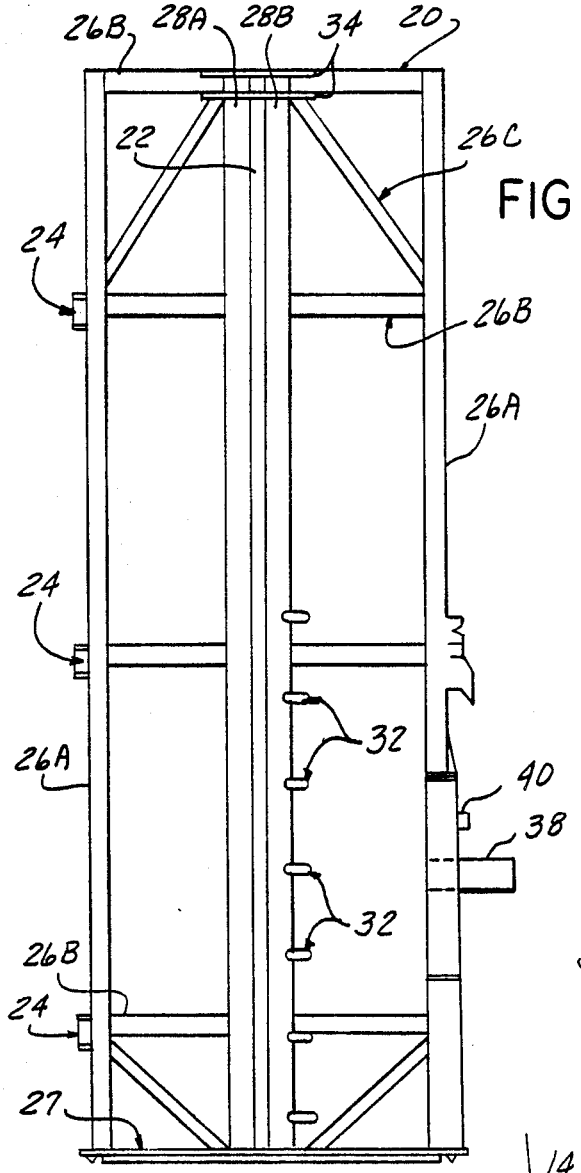
FIG. 4 is a side elevational view of the cage structure of the fencing dispenser shown in FIGS. 1–3.
Figure 5:
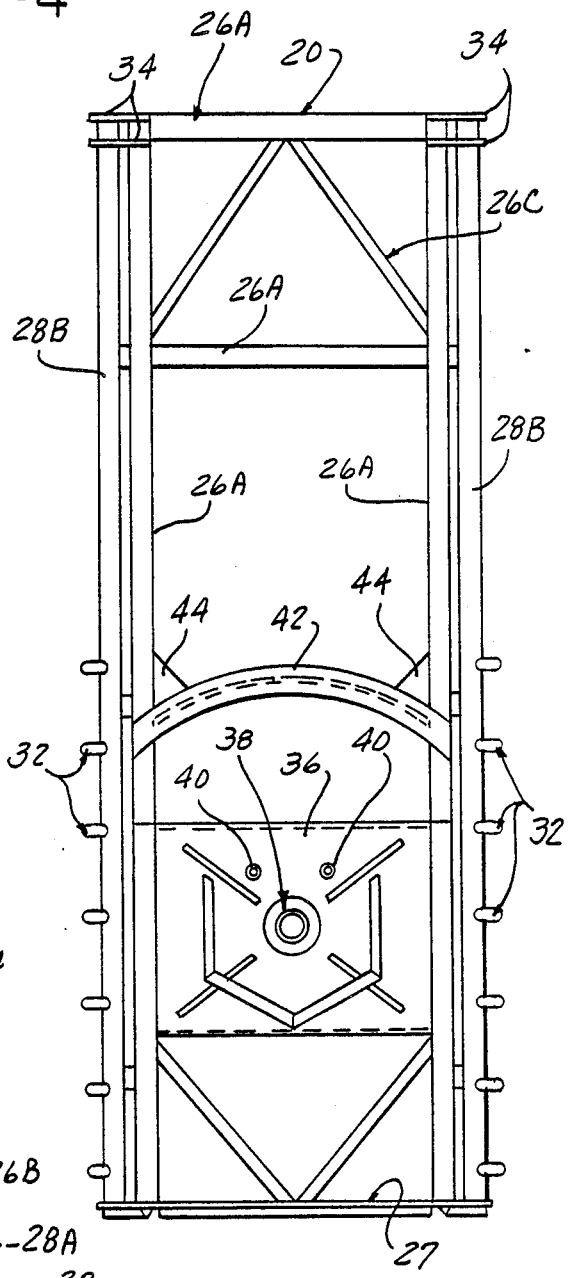
FIG. 5 is a front elevational view of the cage structure shown in FIG. 4.
Figure 6:
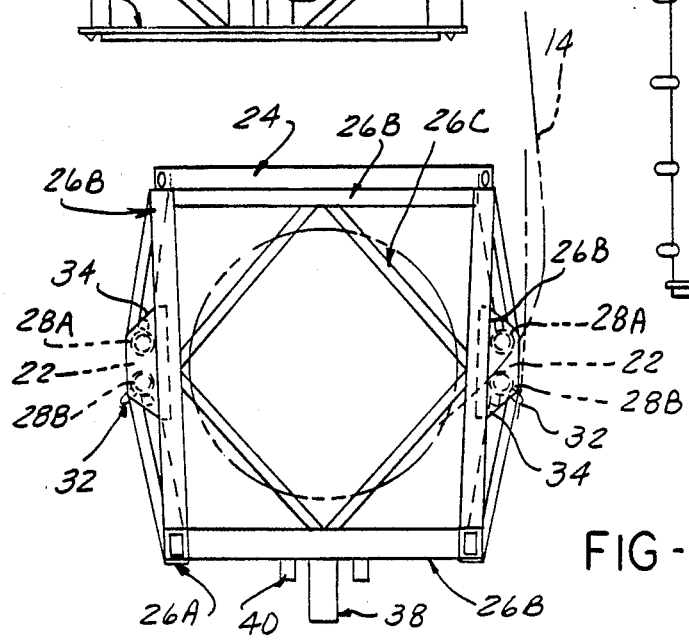
FIG. 6 is a plan view of the cage structure shown in FIGS. 4 and 5, with the outfeed of fencing fabric depicted schematically in phantom.

The cage 20 as shown in FIGS. 4 thru 6, is formed by an elongate four sided open framework of vertical bars 26A horizontal bars 26B, and gusset bars 26C, welded together to form four vertical sides, a front and rear wall and a top and bottom to enclose and support a relatively heavy fencing fabric roll.

Intermediate each side wall is provided a pair of closely spaced posts 28A, 28B, which define the slot 22. The leading posts 28B are provided with a series of fencing fabric engaging pins 32, which are adapted to engage the openings along the edge of the fabric 14 after dispensing thereof, as best seen in FIG. 6.

The post pairs 28A and 28B, lie slightly outboard of the remaining framework of the case 20 and a stiffening plate 34 is welded thereto, are gusset plates 34, provided to secure the posts 28A and 28B to the upper most horizontal bars 26B and a floor plate 27. A solid support plate 36 is mounted at the rear of the cage 20, which in turn has welded thereto a trunnion 38 for pivotally mounting the cage 20 as well as a pair of cylinder mounting bosses 40, for left and right handed pivoting motion depending on the left or right hand feed position of the cage 20.

Figure 7:
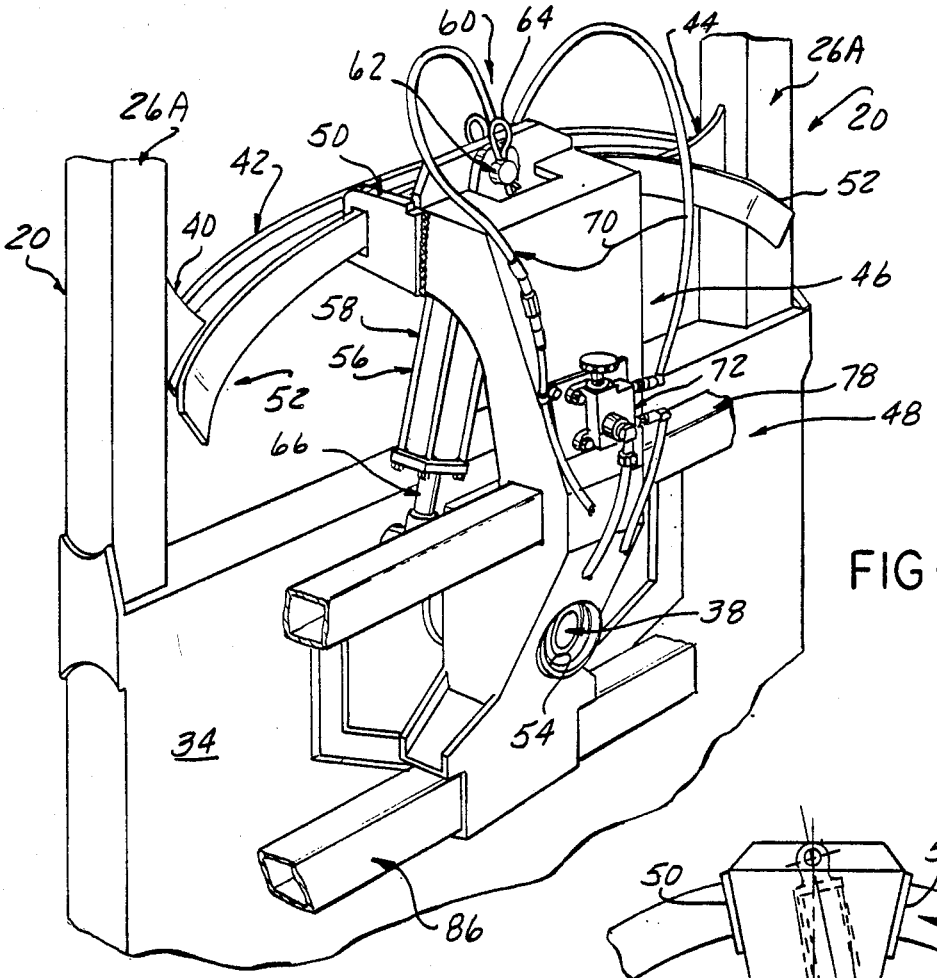
FIG. 7 is a fragmentary perspective view of portions of the cage structure, the cage holder structure, and the hitch mounting frame.

FIG. 7 shows that curved guide channel 42 is also provided welded to the rear pair of vertical bars 26A reinforced with gusset plates 44. The stationary cage holder structure 46, is included in the dispenser 10 according to the present invention, in turn supported on a hitch frame 48 shown in fragmentary form in FIG. 7. The holder structure 46 included a pair of "C" shaped plates 50, and jaw portions engaging the arcuate "I" member 42 as shown in FIG. 7. The stablizer hook plates 50 serve to stabilize the cage 20 in the upright position, resisting tilting thereof by being interengaged with the stationary cage holder structure 46. During pivoting the elements 50 pass off the arcuate "I" member 42 past outwardly flared ends 52. Engagement of the elements 50 with the member 42 is required during dispensing to resist the considerable forces exerted during dispensing and tensioning of the fencing fabric 14 by pulling of the tractor 12.

Figure 8:
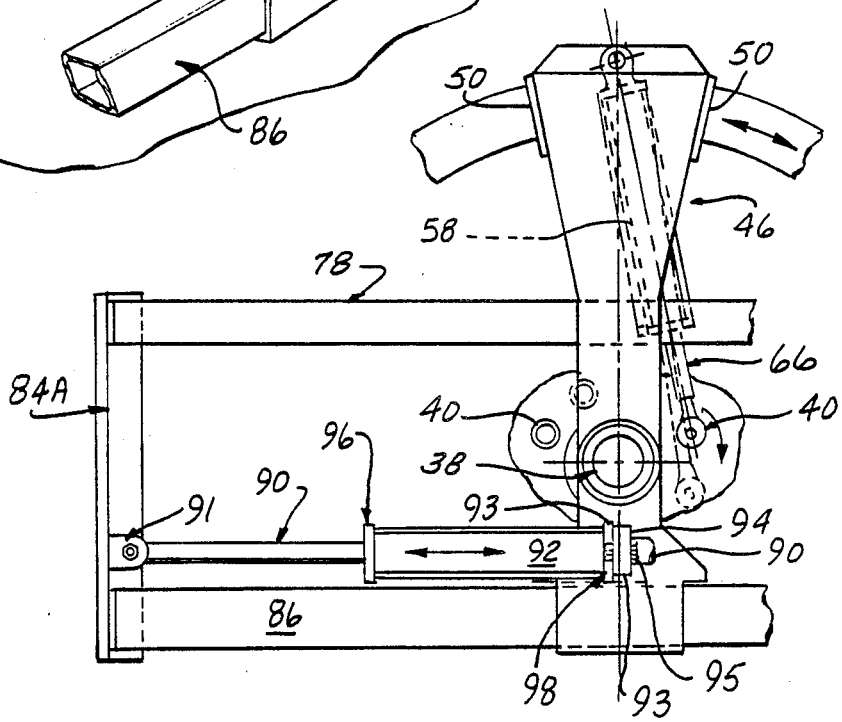
FIG. 8 is a fragmentary rear elevational view of the cage holder and power cylinder depicting the rotational movement induced by operation of the power cylinder.

The cage 20 is pivotally mounted on the holder structure 46, by means of the trunnion 38, being received in a bore 54 formed in the lower region of the holder structure 46 as shown in FIGS. 7 and 8.

In order to provide powered motion, a power cylinder 56 is mounted with the cylinder portion thereof 58, pinned at one end, to the upper end of the holder structure 46, as shown at 60, in FIG. 7 by means of a cross pin 62, and cotter pin 64. A operating rod 66 of the cylinder 56, projects downwardly and is pivoted to either boss 40, depending on whether right or left handed rotation is required since pivoting rotation has to be in one direction or the other depending on the position of the cage 20 side to side with respect to the holder 46.

The piston rod 66 thus is extended upon pressurization of the cylinder 56, as the hydraulic lines 70, and valving 72 cause the cage 20 to be rotated about the axis of the trunnion 38 as indicated in FIG. 8.

Figure 9A:
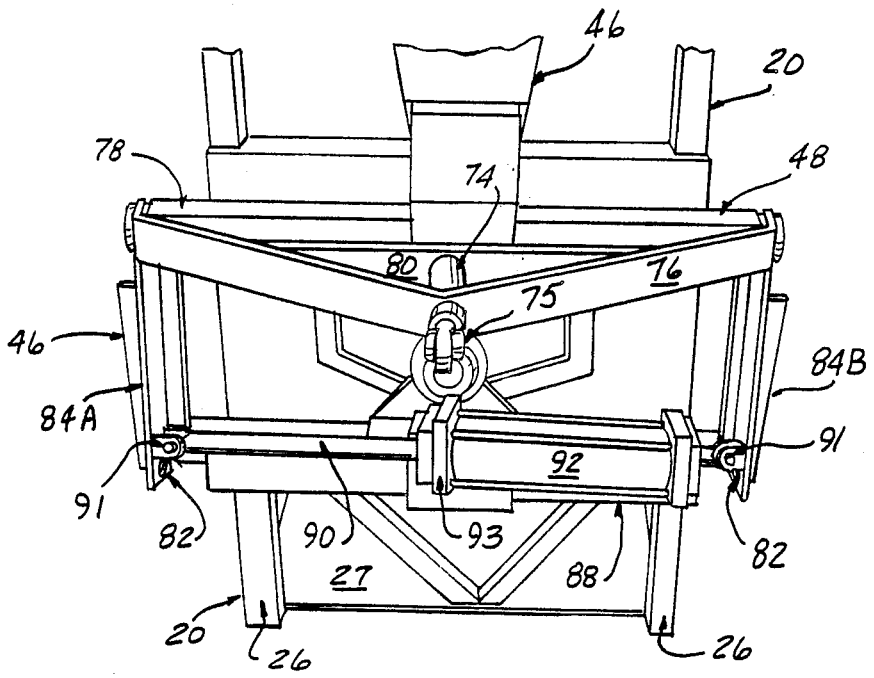
FIGS. 9A and 9B are fragmentary rear perspective views of the cage holder and hitch mounting frame structure depicting the side to side positioning mechanism.
Figure 9B:
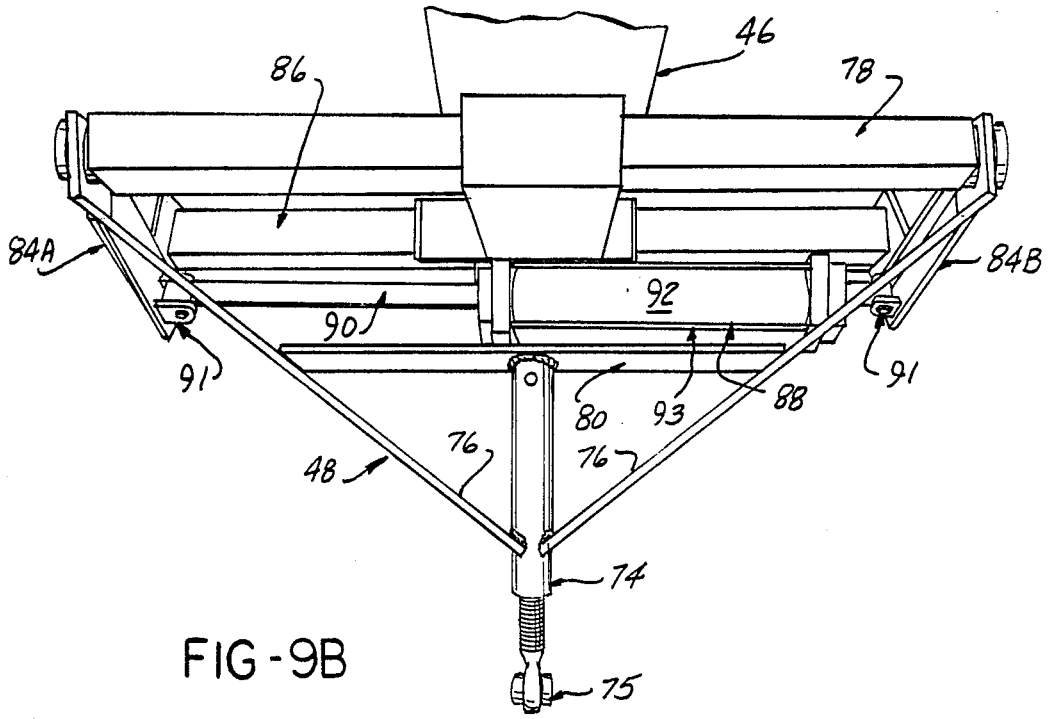

The fabric dispensing apparatus 10 according to the embodiment shown in the proceeding FIGS. 1–8 is intended for rear mounting to a tractor as via a conventional three point hitch (not shown) connected to a hitch frame 48. The hitch frame 48 is illustrated in FIGS. 9A and 9B, which also depicts the side to side powered shifting capability of this embodiment enabling the fencing dispensing apparatus 10 to be position to the left or the right of the vehicle for dispensing around either side.

The hitch frame 48 provides an adjustable length central arm 74 having a socket 75 adapted to be connected to the center point of the three point hitch. Central arm 74 is supported on struts 76 pivoted at either end of an upper way bar 78, and on a cross bar 80. The other two links of the three point hitch may be pinned to openings 82 in the lower ends of side bars 84A and 84B included in the hitch frame 48. Side bars 84A and 84B support both the upper way bar 78 and a second lower way bar 86. The holder structure 46 is slidably mounted on the upper way bar 78 and lower way bar 86 for side to side movement thereon.

In order to provide powered side-to-side movement of the cage 20, a second power cylinder 88 is mounted extending parallel to the way bars 78, 86 with a through operating rod 90 pinned at either end to the clevis 91 fixed at the bottom end of each side bar 84.

The cylinder housing 92, as best seen in FIG. 8, is detachably connected to the holder structure 46 by means of a bracket 93 and a tab 94 welded to the holder structure 46 bolted together by threaded fasteners 95 secured to either a left or right side end plates 96, 98. The power cylinder 88 is double acting, adapted to force the housing 92 either to the right or left when pressurized, carrying the holder structure 46 to the right or left. The alternate attachment to end plate 96 or 98 provides sufficient travel for either left or right hand positioning of the cage 20.

Figure 10:
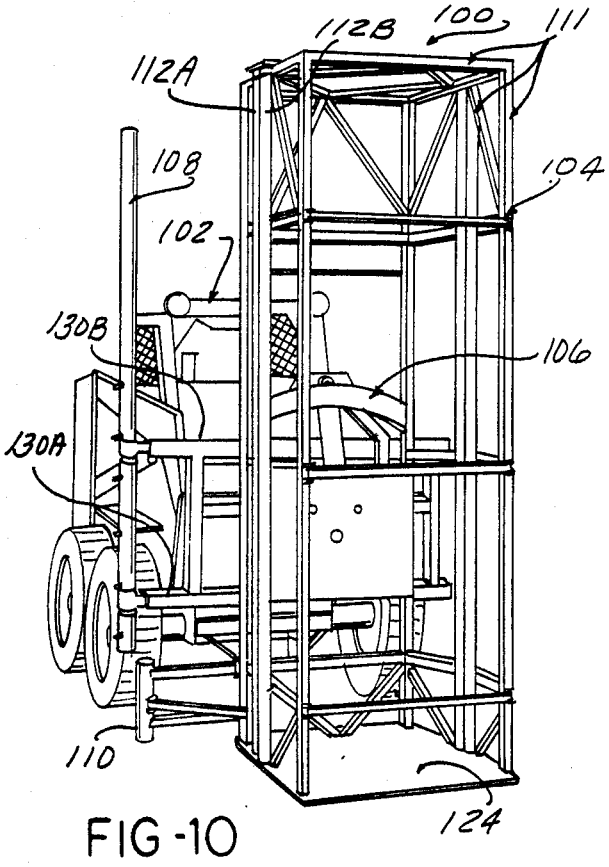
FIG. 10 is a perspective view from the front of a utility vehicle with the front mounted version of the fencing fabric dispenser according to the present invention installed thereon.

Referring to the front mounted version of the fencing dispenser 10 according to the present invention 25 illustrated in FIG. 10, this version of the dispenser 100 is installed on a utility vehicle 102. The fencing dispenser 100 according to this embodiment also includes a fencing holding cage 104 and a cage holder structure 106 mounted to the front end of the vehicle 102.

This embodiment features an outrigger fixed guide post 108 as well as a detachable lower outrigger guide post 110, mounted to the cage 104 to move therewith. The fixed outrigger pole 108 is positionable on either side of the vehicle 102, whereas the cage 104 remains fixed in a central position A lower outrigger pole 110 is readily detachable and mounted on either side of the cage structure 104, depending on the left or right hand dispensing of the fencing fabric.

Figure 11:
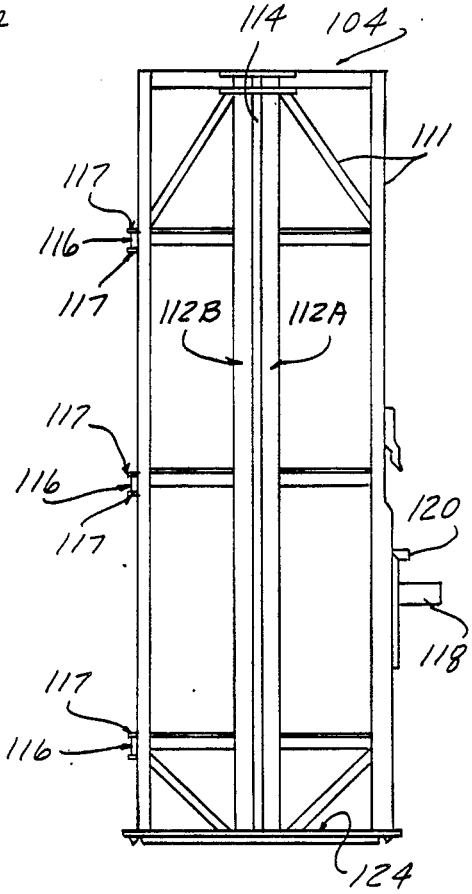
FIG. 11 is a side elevational view of the dispenser cage included in the fencing fabric dispenser shown in FIG. 10.
Figure 12:
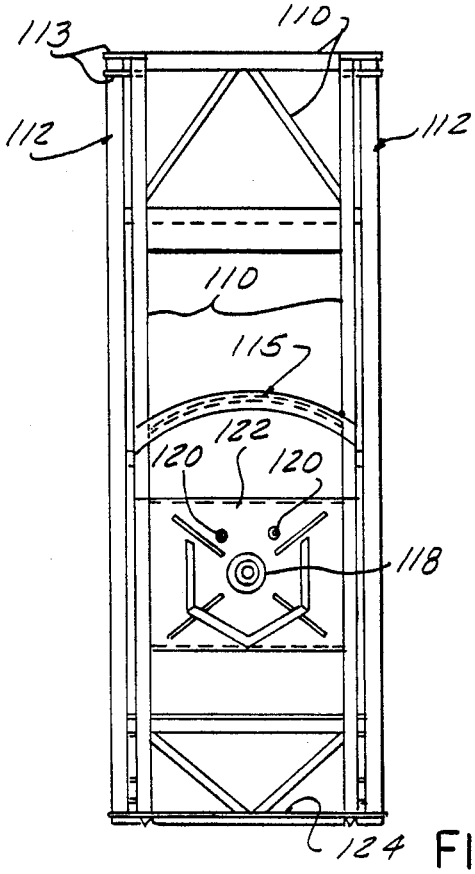
FIG. 12 is a rear elevational view of the cage structure shown in FIG. 11.
Figure 13:
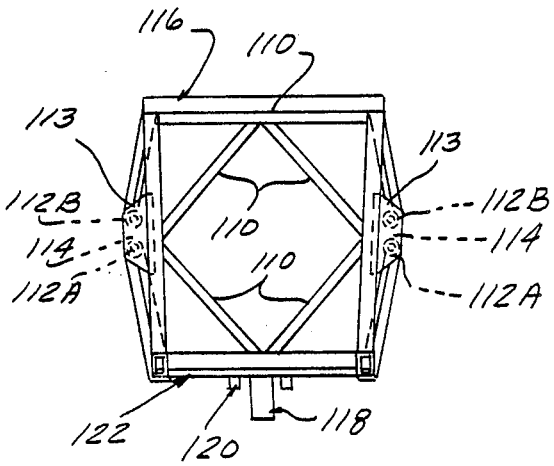
FIG. 13 is a plan view of the cage structure shown in FIGS. 11 and 12.
Figure 14:
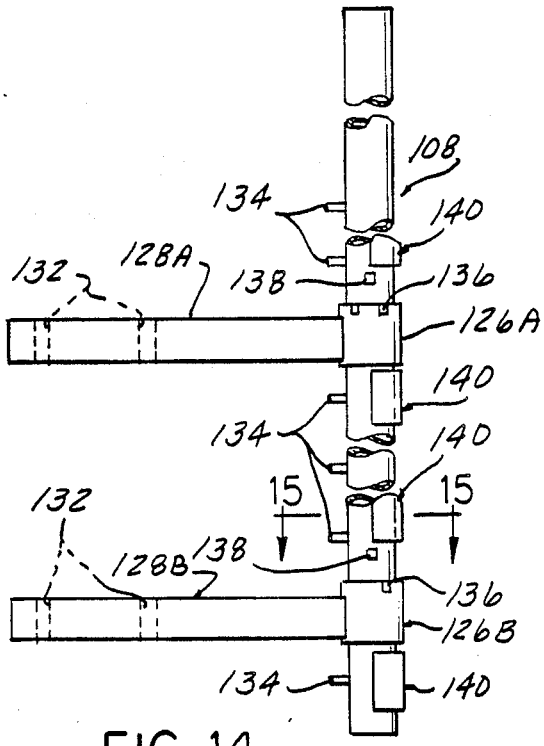
FIG. 14 is a fragmentary elevational view of the fixed guide posts incorporated in the fencing dispenser apparatus according to the present invention shown in FIG. 10.
Figure 15:
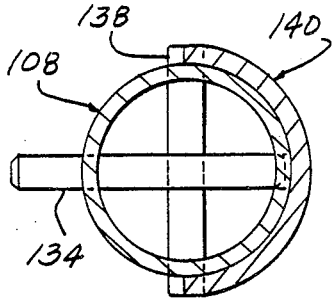
FIG. 15 is a sectional view taken through the lines 15–15, in FIG. 14.
Figure 16:
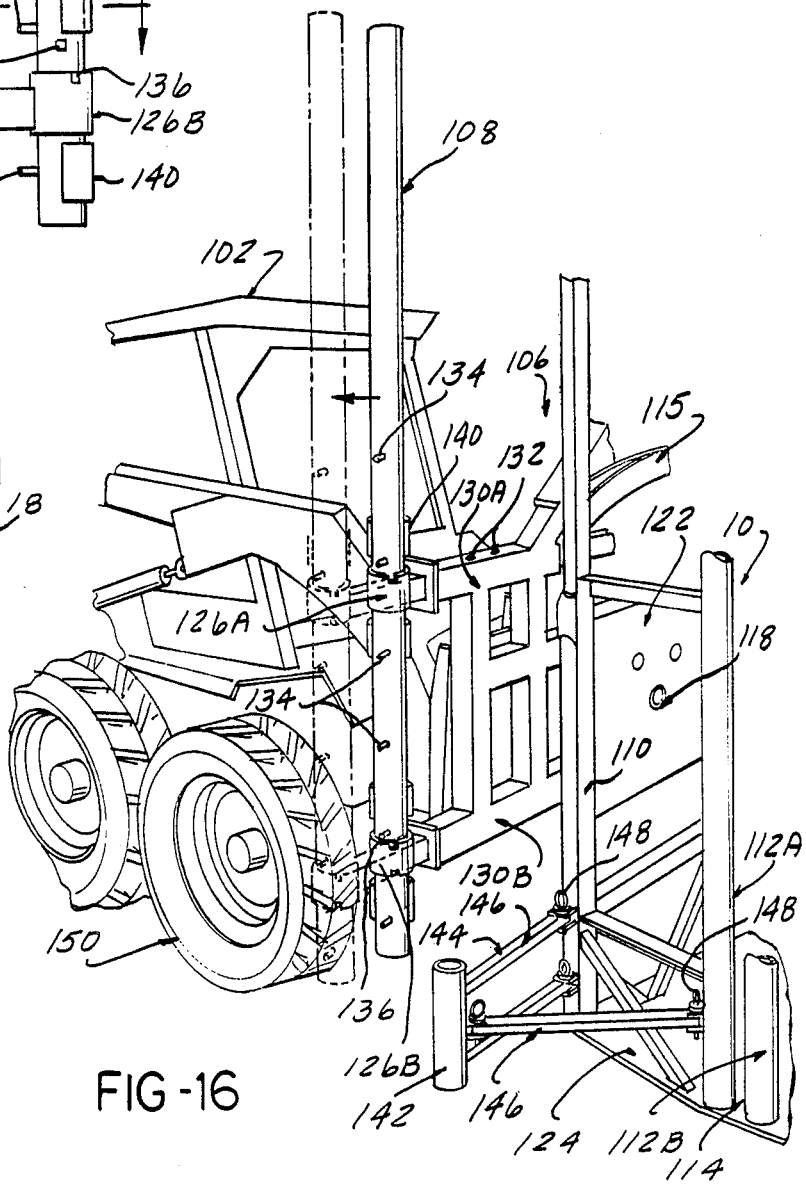
FIG. 16 is an enlarged fragmentary perspective view of a second embodiment of fencing dispenser apparatus according to the present invention, mounted to the forward portion of a utility vehicle and illustrating in detail the fixed guide posts and the lower movable guide posts incorporated in the fencing dispenser shown, and showing in phantom the adjustability of the fencing guide post.

Cage 104, as in the previously described embodiment, is comprised of a generally retangular elongated open frame work formed by welding together a series of members 111, with a pair of trailing and leading spaced posts 112A and 112B with a gap 114 therebetween to receive the fencing fabric from a roll disposed in the interior of the cage 104. Releasable arms 116 are provided as before at the forward end of the cage structure 104. A trunnion 118 and cylinder anchor bosses 120 are provided in a mounting plate 122 secured to the rear corner members 110 at plate 122 as illustrated in FIGS. 11 through 13. A bottom plate 124 providing a sturdy support for a roll 18 of fencing fabric 14 is disposed therein. Gussets 113 secure the posts 112A and 112B to the tubing members 111. The fixed guide posts 108 is received in upper and lower collar members 126A and 126B as best seen in FIG. 14, which in turn are welded to support bars 128A and 128B, received in the open ends of square tubing members 130A and 130B of the holder frame 106 and slidable therein in order to enable in and out adjustment as indicated in FIG. 16 to locate the guide posts 108, outboard of the side of the vehicle 102.

Vertical bores 132 are provided in each of the members 128A and 128B, to accommodate locking pins (not shown) to lock the support bars 128A and 128B, in an adjusted position within the square tubing members 130A and 130B.

The guide post 108 is provided with a series of fabric engaging pins 134 protruding radially outwardly from the guide posts 108. The guide post 108 is adjustable angularly in two different positions, so as to move the engagement pins 134, in between an engaging and non-engaging position. Such adjustable position is defined by a pair of slots 136, formed into the upper perimeter of the collars 126A and 126B, cooperating with a square pin 138 affixed above each locking collar 126A and 126B, such that the guide post 108 may be positioned with the pins 134 in either slot 136, such as to maintain the angular position of the guide post 108, with the engagement pins 134 either trailing or facing the fencing fabric openings to enable secure engagement, preparatory to performing the fencing operation.

Spacer tubing segments are welded to the outside of the posts 108 in order to provide a continuous surface flush with the collars 126A, over which the fencing fabric passes as the dispensing operation is proceeding.

After the dispensing is complete, the post 108 is repositioned with the engagement pins 134 facing towards the fencing dispenser cage 104, so as to engage and hold the fencing fabric.

In addition to the fixed main guide post 108, a smaller, lower guide post 142 is provided, held on a support frame 144 formed by a series of individual struts 146, held by means of quick release pins 148, to the cage frame members 111 and trailing posts 112A such as to be installed on either side of the cage 104.

Figure 17:
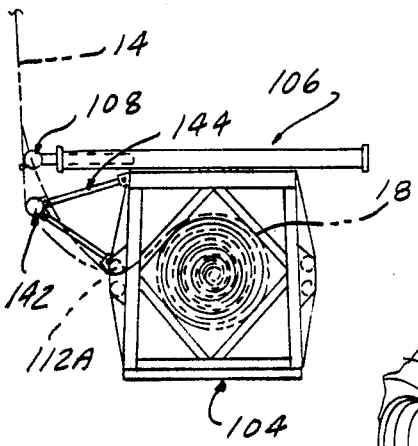
FIG. 17 is a plan view of the fencing fabric dispenser according to the second embodiment depicting the outfeed of fencing fabric from the cage structure and past the fixed and movable guide post members; and also illustrating in detail the fixed guide post and the lower movable guide post incorporated in the fencing dispenser according to the second embodiment of the present invention.

The position of the lower moveable post 142 is ahead of the main guide post 108, to produce a particular effect on the fence fabric 14 as it is paid out from the roll 118. As indicated in FIG. 17 the lower guide post 142 is slightly outboard of the line of tangency between guide post 108 and the trailing post 112A past which the fabric 114 passes during dispensing. Thus the fabric folds inwardly above the post 142, which creates an effective force tending to cause the fabric to ride up the post 108 and keep the fabric 14 from becoming engaged with the wheels 150 of the vehicle 102.

Figure 18:
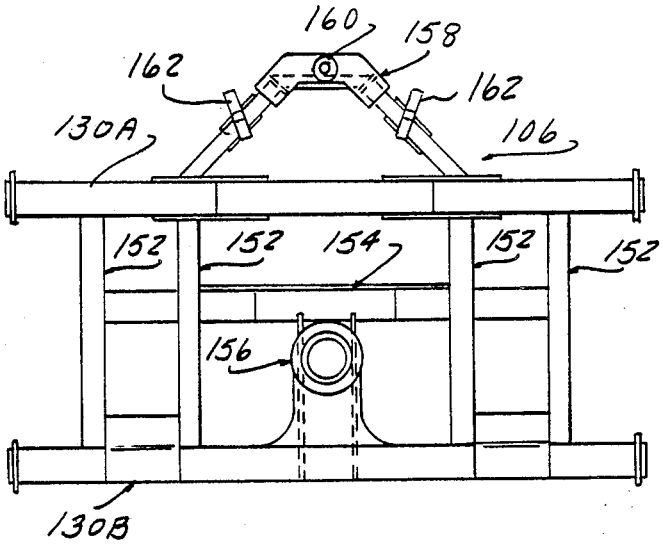
FIG. 18 is a rear elevational view of the cage holder structure incorporated in the second embodiment of the fencing dispenser according to the present invention.
Figure 19:
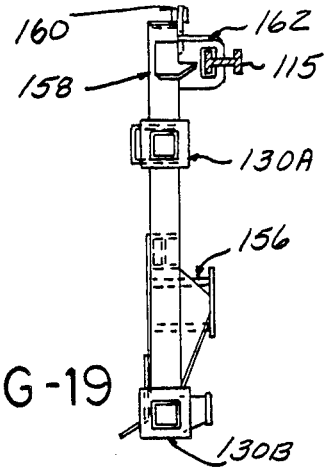
FIG. 19 is a side elevational view of the cage holder structure shown in FIG. 18 together with a portion of the cage structure engaged thereby.
Figure 20:
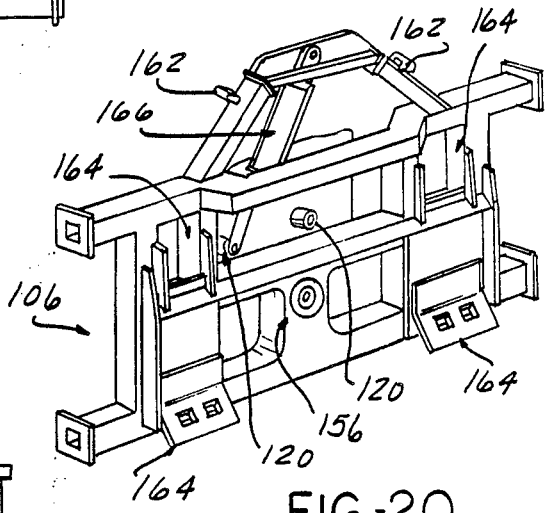
FIG. 20 is a perspective view of the holder structures shown in FIGS. 18 and 19.
Figure 21:
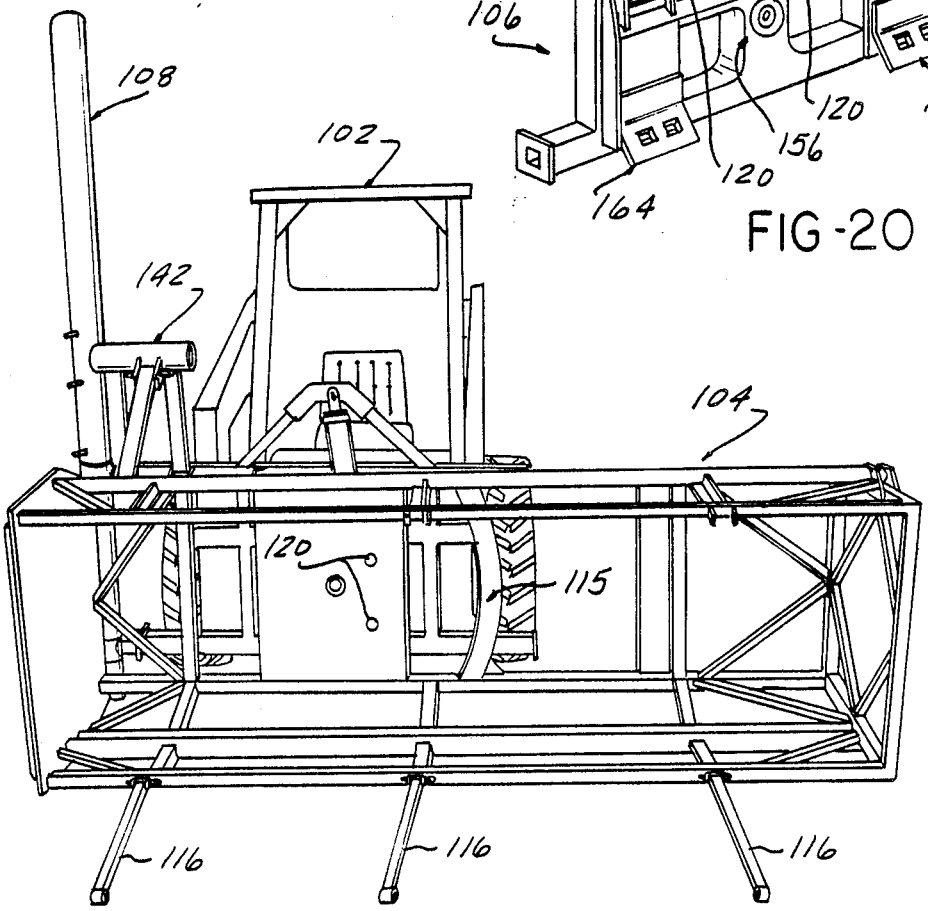
FIG. 21 is a rear perspective view of the vehicle and fencing fabric dispenser according to the second embodiment with the cage structure in the horizontal fence roll loading condition.

The cage 104 as well as the guide post 108 are supported on the holder frame 106 as illustrated in FIGS. 18–20. The holder frame 106 is comprised of a weldment including the square tubing members 130A and 130B previously described as well as vertical members 152 welded in position to connect the members 130A and 130B as well as a cross member 154 reinforcing a trunnion socket member 156. Above the upper bar member 130A, there is provided a supporting frame work 158 for a cylinder mounting pivot 160 and a pair of guide pieces 162, having open jaws engaging the arcuate piece 115.

The holder frame 106 is adapted to be picked up by the vehicle 102, by means of standard adapters 164. The power cylinder 166 is pivotally mounted at the housing end to the pivot 160, and having its operating rod pivoted to either connection 120 depending on the direction of swing of the cage required. In similar fashion to the first described embodiment, as shown in FIG. 1, the cage 104 may be rotated from an upright to a horizontal position, carrying the lower guide posts 142 with it. With the bar members 116 disconnected at the upper end, an opening is created to allow rolling in the roll 18 of fencing fabric 14 over the bar members 116.

It may be desirable to provide an adjustable angle guide post 108A, by pinning the lower end at 162 to the holder frame 106, and at an intermediate point 164 to the upper square tube **128*a*. A clevis 166 is welded to the upper square tube 128*a*, which is pinned to the outer end of the operating rod 168 of a double acting cylinder 170. Actuation of the power cylinder 170 is accomplished by pressurization of lines 172, 174**.

Figure 23:
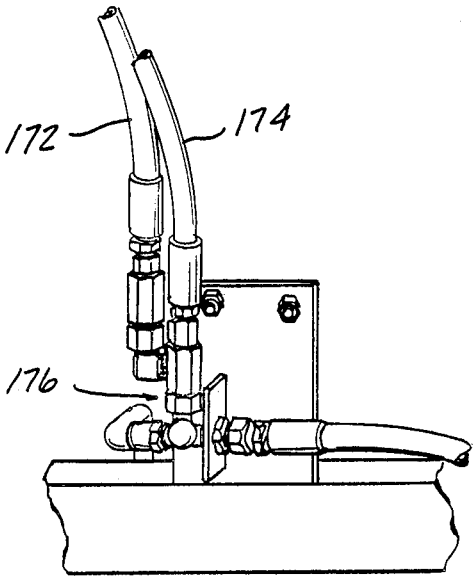
FIG. 23 is a fragmentary view of hydraulic lines and valves associated with the guide post actuator.
Figure 22:
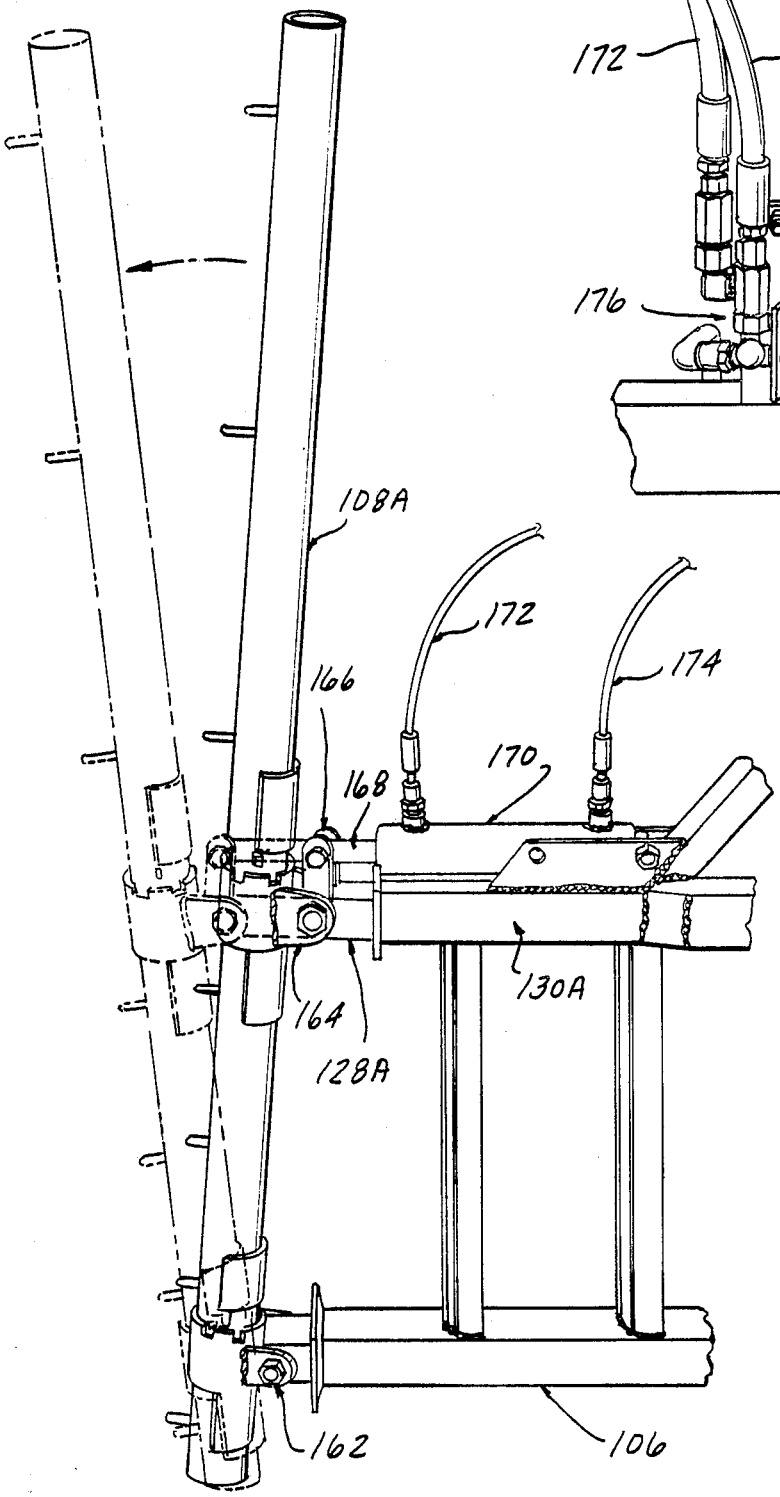
FIG. 22 is a fragmentary rear view of the guide post and associated frame portions showing in phantom the post in an inclined position.

As seen in FIG. 23, the guide post 108A may thus be tilted to compensate for changing grades. The lines 172 and 174 are pressurized by a diverter valve 176, diverting flow from the tilt cylinder for the cage, to enable the hydraulic pressure to be utilized for guide post angle adjustment. A control valve (not shown) enables progressive actuation to position the guide post in a selected adjusted position to compensate for a uneven ground surface.

Accordingly, it can be appreciated that a relatively simple, rugged and reliable fencing dispenser has been provided, which is a substantial improvement in efficiency over the prior art fencing dispensers provided for such purpose.

We claim:

1. A dispensing apparatus for dispensing fencing fabric from a roll of fabric to be carried by a vehicle, said apparatus comprising:

a cage comprising an elongated enclosure configured to receive a roll of fencing fabric therein, said cage including structure extending across one side thereof, a gate extending along the length of said cage, said one side being releasably connected on one side to the remaining cage structure and hinged along the other side to be openable to enable loading of a roll of fencing fabric into said cage;

cage holder structure adapted to be mounted to said vehicle, said cage holder structure including means pivotally supporting said cage structure and power cylinder means drivingly connected to said cage and said cage holder structure to allow selective driving of said cage from an upright position whereat said fencing fabric is dispensed, to a horizontal position with said gate vertically positioned away from said vehicle; power means for thereafter lowering said pivoted cage to position said cage horizontally at grade level whereat said roll may be loaded through the open side of said cage created after opening of said gate, said roll able to be advanced into said cage interior, said gate, closed, said power means thereafter raising said cage, and said power cylinder means pivoting said cage to an upright position ready for dispensing of said fencing fabric from said roll.

2. The dispenser apparatus according to claim 1 wherein said gate comprises a series of transverse arms releasably secured at either end to said cage.

3. The dispenser apparatus according to claim 1 wherein said means pivotally supporting said cage on said cage holder structure includes a trunnion, and further including an arcuate member and one or more engagement elements each drivingly connected to said cage, said engagement elements engaging said arcuate member when said cage is in the upright position to stabilize said cage on said trunnion.

4. The dispenser apparatus according to claim 1 wherein said cage includes pairs of spaced posts defining respective slots out which said fencing fabric can pass to the side, thereby enabling right or left hand dispensing.

5. The dispenser apparatus according to claim 4 wherein one of each of said pairs of posts carries a series of protruding engagement pins for engaging said fencing fabric to stretch the same by movement of said vehicle.

6. The dispenser apparatus according to claim 4 further including an upright guide post, means adjustably mounting said guide post to said cage holder structure alternatively on either side thereof, and located outboard of said cage to receive fencing fabric therefrom and guide the same around the vehicle which carries said case holder structure and cage.

7. The dispenser apparatus according to claim 6 wherein said means adjustably mounting said guide post to said cage holder structure allows selective positioning of said guide post in a plurality of rotated positions, and a series of protruding engagement pins fixed to said guide posts and positioned in a direction to engage fencing fabric dispensed from said cage in a first position of said guide post, but out of engagement in a second rotated position.

8. The dispenser apparatus according to claim further including an upright lower guide post detachably fixable to either side of said cage, lying below the bottom of said guide post and located forwardly thereof to guide a lower region of said dispensed fabric fencing.

9. The dispenser apparatus according to claim 1 further including a hitch frame and wherein said holder structure is laterally mounted on said hitch frame for side to side movement, and further including power cylinder means for selectively moving said holder structure and cage from one side to the other of said vehicle.

10. The dispenser apparatus according to claim 9 wherein said hitch frame includes a pair of spaced transverse bars on which said holder structure is mounted for sliding movement and includes a power cylinder extending parallel thereto, said power cylinder having a cylinder housing and an actuating rod extending out from both ends of said cylinder housing, said cylinder housing attached to said holder structure and said actuating rod attached at either end to one of said transverse bars.

11. The dispenser apparatus according to claim 6 wherein said guide post mounting means enables variable inclination mounting of said guide post.

12. The dispenser apparatus according to claim 11 further including power actuation means driving said guide post to various selected inclinations.

* * * * *